US012122564B2

(12) United States Patent
Serviuc Pavezi et al.

(10) Patent No.: US 12,122,564 B2
(45) Date of Patent: Oct. 22, 2024

(54) INSERT MOULDABLE AND ULTRASONICALLY WELDABLE CLOSURE ASSEMBLY FOR PLASTIC PACKAGING

(71) Applicant: GREIF INTERNATIONAL HOLDING BV, Amstelveen (NL)

(72) Inventors: Alex Fernando Serviuc Pavezi, Paraná (BR); Marcos Schemly, Paraná (BR)

(73) Assignee: GREIF INTERNATIONAL HOLDING BV, Amstelveen (NL)

( * ) Notice: Subject to any disclaimer, the term of this patent is extended or adjusted under 35 U.S.C. 154(b) by 104 days.

(21) Appl. No.: 17/915,997

(22) PCT Filed: Mar. 25, 2021

(86) PCT No.: PCT/EP2021/057769
§ 371 (c)(1),
(2) Date: Sep. 29, 2022

(87) PCT Pub. No.: WO2021/198022
PCT Pub. Date: Oct. 7, 2021

(65) Prior Publication Data

US 2023/0146015 A1 May 11, 2023

(30) Foreign Application Priority Data

Apr. 2, 2020 (GB) ..... 2004900

(51) Int. Cl.

| | |
|---|---|
| ***B65D 47/06*** | (2006.01) |
| ***B65D 47/10*** | (2006.01) |
| ***B65D 47/12*** | (2006.01) |
| ***B65D 53/02*** | (2006.01) |

(52) U.S. Cl.
CPC ..... *B65D 47/063* (2013.01); *B65D 47/103* (2013.01); *B65D 47/12* (2013.01); *B65D 53/02* (2013.01); *B65D 2401/15* (2020.05)

(58) Field of Classification Search
CPC .... B65D 47/063; B65D 47/103; B65D 47/12; B65D 53/02; B65D 2401/15; B65D 47/06; B65D 47/10
See application file for complete search history.

(56) References Cited

U.S. PATENT DOCUMENTS

| | | | | |
|---|---|---|---|---|
| 4,422,563 A * | 12/1983 | Babiol | B65D 47/063 222/530 |
| 5,004,126 A * | 4/1991 | Klesius | B65D 47/063 215/256 |
| 5,221,028 A | 6/1993 | Dwinell | |
| 5,641,099 A * | 6/1997 | McLelland | B65D 47/063 222/541.9 |

(Continued)

OTHER PUBLICATIONS

International Search Report and Written Opinion mailed Jun. 28, 2021 by the European Patent Office as International Searching Authority for counterpart International Patent Application No. PCT/EP2021/057769.

(Continued)

*Primary Examiner* — James N Smalley
(74) *Attorney, Agent, or Firm* — Armstrong Teasdale LLP

(57) ABSTRACT

A closure assembly (10) for plastic containers comprises a neck insert (12) and a closure cap or plug (26). The closure assembly is configured to be fixed and sealed to the container either by insert-molding or by ultrasonic welding.

21 Claims, 6 Drawing Sheets

(56) References Cited

U.S. PATENT DOCUMENTS

| | | | | |
|---|---|---|---|---|
| 5,788,100 | A * | 8/1998 | Sturk | B65D 47/103 222/541.9 |
| 5,823,377 | A | 10/1998 | Krautkrämer | |
| 5,899,364 | A * | 5/1999 | McLelland | B65D 25/44 222/530 |
| 5,967,376 | A | 10/1999 | McLelland et al. | |
| 8,814,004 | B2 * | 8/2014 | Letica | B65D 47/063 222/153.07 |

OTHER PUBLICATIONS

Search Report under Section 17 mailed Jan. 8, 2021 by the Intellectual Property Office of the United Kingdom for priority GB application No. 2004900.3.

* cited by examiner

INSERT MOULDABLE AND ULTRASONICALLY WELDABLE CLOSURE ASSEMBLY FOR PLASTIC PACKAGING

FIELD OF THE INVENTION

This invention concerns packaging, more specifically closure assemblies for plastic packaging of various forms and applications. The invention particularly although not exclusively relates to closure assemblies comprising a removable closure cap or stopper and corresponding neck insert or neck finish such as a foldable pouring spout, for sealed attachment over a filling/discharge opening in a plastic packaging container or in a component of such a container; for example closure assemblies for sealed attachment over a filling/discharge opening in a plastic pail lid.

BACKGROUND OF THE INVENTION

Known packaging closure solutions have one or more points of contact and sealing that in certain forms hinder production of finished packaging containers, due to high complexity and high material consumption. Other forms do not present the necessary fluid and/or security (tamper indicating) seal and some forms even cause difficulty in installing and/or removing the closure cap or plug (opening/closing of the finished container).

The state of the art presents closure cap/plug and neck finish/pouring spout assemblies that do not have constructional details with dual functionality as regards methods of fixation and sealing in or over the filling and discharge opening of a corresponding container or container component; i.e. lacking constructional details providing anchoring for the process of insert molding, and energy guidance for the process of ultrasound welding; as well as lacking mechanical anchorage contributing to the increase in the level of fixation, fluid sealing and physical security of the closure system.

The state of the art presents plastic closure assemblies providing several technical solutions for the sealed closing of packaging containers, but without offering simplicity of installation of the closure cap or plug and its neck or pouring spout by the packaging manufacturer or packaging filler in industrial processes, as well as providing a fluid-tight tamper-evident closure serving for the two sealing/fixation modalities, i.e. permitting sealing and fixation to the container either by insert-molding or by ultrasonic welding, and which as well is easy to open and optionally easy to reclose by the end customer.

U.S. Pat. No. 5,823,377 relates to a bellows type pull-out spout which is ultrasonically welded to a plastic container lid (e.g. a pail lid) as a tamper-indicating security measure. A spout end of the bellows is fitted with a screw cap. A base end of the bellows is sealed to an aperture in the container lid by a "sealing foot" of L-shaped cross-section, using a mechanical interference fit. One arm of the L defines a short cylindrical connection piece received in the container aperture. The other arm of the L forms a radial flange extending next to the container lid, around the aperture. A ring shaped extension (or sector shaped extensions) breakably connected to the screw cap (or to bail-type pull up handles attached to the screw cap) is/are ultrasonically welded to the container lid. The extension(s) is/are provided with a groove for accepting an ultrasonic welding tool and a ridge forming a "direction guide" for concentrating the ultrasonic energy and forming the weld. The extension(s) is/are recessed to accommodate the sealing foot radial flange and has/have a non-weld forming ridge which presses against the softer material of the sealing foot radial flange to press it against the container lid and help to seal and stabilize the sealing foot in the container/lid aperture.

U.S. Pat. No. 5,967,376 discloses an insert molded, tamper evident, bellows type, pull-out pouring spout and closure cap assembly. A container lid is insert-moulded to flushly engaged peripheral flanges of a base of the spout and of a tamper ring. The tamper ring is frangibly attached to bail handles of a cap screwed onto the spout. The lid is moulded such that it envelops the peripheral flanges of the spout base and tamper ring. A diverter flange is used to form a restricted passageway in the mold, to ensure even flow of molten plastic to meet the engaged peripheral flanges during insert injection moulding. The spout base flange extends radially outward of the tamper ring flange and comprises anchoring projections around which the lid material is moulded to provide a leak proof integral bond. Peripheral clamping flanges for the closure assembly in the mould may have annular pinch beads which "bite" into the spout base and tamper ring flanges to retard movement of the closure assembly under pressure from the molten plastic. Instead of the anchoring projections, the outer periphery of the spout flange may be provided with an annular blocker bead extending upwardly to block direct radial access to the seam between the spout base and tamper ring flanges. A skirt mass at the outer periphery of the spout flange provides additional material which stiffens the spout flange against distortion by the mould clamping forces and the pressure of the molten plastic. An annular tongue may be provided on the tamper ring flange to bite into the spout base flange under the mould clamping forces, to prevent relative movement and to prevent intrusion of molten plastic.

U.S. Pat. No. 5,221,028 discloses a pail lid spout securing arrangement, in which a tubular nozzle throat of the spout flange is snap-fitted through a pail lid pouring aperture and ultrasonically swaged to secure the spout in the aperture.

SUMMARY OF THE INVENTION

The present invention provides a closure assembly for a container, the closure assembly comprising:

- a neck insert formed from a plastics material and comprising (a) a through-going passageway, (b) an annular base flange sealingly securable about an opening in the container so as to provide sealed fluid communication between the passageway and the opening in the container, and (c) an open end through which fluid can be dispensed from the container;
- and a closure plug or cap removably securable to the neck insert so as to provide an openable fluid-tight seal across the open end;
- the closure cap or plug having a tamper-indicating anchor piece formed from a plastics material and attached to the closure cap or plug by a frangible connection, an edge part of the tamper-indicating anchor piece extending adjacent to a peripheral region of the annular base flange, whereby the closure assembly can be insert molded into the opening of the container, with material of the container sealingly molded around the peripheral region of the annular base flange and around the edge part of the tamper-indicating anchor piece;
- characterized in that an ultrasonic energy-directing protrusion spans between adjacent surfaces of the tamper-indicating anchor piece and of the annular base flange, and an annular, ultrasonic energy-directing ridge extends from a lower surface of the annular base flange, outboard of the through-going passageway, whereby as an alternative to securing by insert-molding, the tamper-indicating anchor piece is securable by ultrasonic welding to the annular base flange and the annular base flange is securable by ultrasonic welding to an outer wall surface of the container surrounding the opening in the container, so as to provide the sealed fluid communication between the passageway and the opening in the container. Here and in the following, the term "container" includes within its scope parts of a container, such as a container lid. The closure assembly of the present invention is therefore more versatile than closure assemblies that may be installed in a container opening only by insert molding or only by ultrasonic welding. It may be installed by either method, for example depending upon the equipment available to the container manufacturer or container filler. Together, the tamper-indicating anchor piece and the annular base flange may have a low profile, which facilitates the anchoring of the closure assembly in the container opening in automated or manual manufacturing systems and also locking the assembly in place in the opening by insert molding.

Whichever is used, (i) the container material sealingly molded around the peripheral region of the annular base flange, and (ii) the ultrasonic weld between the annular base flange and the outer surface of the container wall surrounding the container opening, both provide a complete fluid-tight seal and secure mechanical fixation between the closure assembly and the corresponding container. This seal and fixation is in addition to any mechanical interengagement or resilient sealing that may be provided between the annular base flange and the container opening, e.g. via a snap-in collar extending downwardly from the annular base flange which is pressed into the container opening. Such a snap-in collar or similar mechanical interengagement means may also facilitate placement and retention of the closure assembly in the correct position within the opening of a pre-molded container, ready for the ultrasonic welding operation; or placement and retention of the closure assembly in the correct predetermined position within a mold tool, ready for closure of the mold and formation of the container about the closure assembly by insert molding. In both cases, such placement may be manual or automatic, e.g. by a pick-and-place robot or the like. Alternatively the mechanical interengagement means may be used to provide an additional mechanical key when the closure assembly is fixed and sealed to the container by insert-molding.

The tamper-indicating anchor piece may comprise a ridge protruding from its upper surface. This may help to stiffen the tamper-indicating anchor piece and perhaps other components of the closure assembly supported thereby, to better resist distortion when heated and subjected to the pressure of molten plastic during the insert-molding process; as well as resisting distortion during the ultrasonic welding process or processes. To improve such resistance, the protruding ridge may be supported in or against part of the mold tool during the insert molding operation. The protruding ridge may also serve to surround, partially house and physically protect the exposed parts of the closure cap or plug and the frangible connection to the tamper-indicating anchor piece in use in the supply chain or in use by the end customer; while still allowing easy access for removal of the closure cap or plug from the open end of the neck insert.

The tamper-indicating anchor piece may be annular, whereby the frangible connection may be provided substantially around the entire circumference of the closure cap, e.g. as a spaced series of frangible bridges.

Alternatively, a plurality of such tamper-indicating anchor pieces may be provided, e.g. at various positions spaced about the periphery of the closure assembly.

The tamper-indicating anchor pieces may be shaped as arcuate segments, for example.

The closure assembly may comprise two or more of the energy-directing protrusions spaced from each other in a direction extending crosswise to the container opening. This provides greater strength and security to the ultrasonic weld by which the corresponding tamper-indicating anchor piece may be fixed to the annular base flange. When the closure assembly is fixed in the container opening by insert-molding, one or more of the energy-directing protrusions (rather than being used in ultrasonic welding) may be arranged to be compressed by co-operating parts of the mold tool so as to bite into and/or deform against the annular base flange. This provides a seal which resists penetration between the tamper-indicating anchor piece and the annular base flange, of the injected molten plastic used to form the container. Closure assemblies supplied to the container manufacturer or filler in this unwelded condition can also be installed in or over the opening in a pre-molded container by ultrasonic welding. In such case, the welding of the tamper-indicating anchor piece to the annular base flange and the welding of the annular base flange to the container may take place in a single operation, i.e. with one application of an ultrasonic welding tool. Alternatively one or more of the energy-directing protrusions may be used to ultrasonically weld the tamper-indicating anchor piece to the annular base flange even in the case where the closure assembly is to be fixed and sealed in the container opening by insert-molding. That is, all of the closure assemblies may be supplied from the manufacturer to the container manufacturer or filler, with the tamper-indicating anchor pieces pre-welded to the annular base flanges, using the energy-directing protrusions. The pre-welds provide additional security to ensure that the closure cap or plug is not detached prior to use of the closure assemblies by the container manufacturer or filler. The pre-welds also provide a mechanical connection and fluid seal between the tamper-indicating anchor piece and the annular base flange to resist the above-described intrusion of molten plastic along the interface between these components, when the closure assembly concerned is installed in its container by insert-molding. Naturally, such pre-welded closure assemblies may be installed in/over container openings by ultrasonic welding, via the annular, ultrasonic energy-directing ridge, as an alternative to being installed in/over container openings by insert-molding.

The closure cap or plug may comprise a bail handle which can be hinged upwardly for manipulation of the closure cap or plug, e.g. for its removal or installation over or in the open end of the neck insert and/or for extension or folding of the neck insert to provide an extendable and stowable pouring spout; the frangible connection being attached to the bail handle so as to be at least partially broken when the bail handle is hinged upwardly. A further frangible connection may be made between the bail handle and the remainder of the closure cap or plug and which is also arranged to be broken when the bail handle is hinged upwardly. The frangible connection(s) thereby provide tamper indications.

The bail handle may have a raised center portion defining recess beneath it (providing finger access, permitting the bail handle to be raised without the use of tools).

The tamper-indicating anchor piece may have a recess adjacent to a center part of the bail handle. (This provides similar finger access; and an optional engagement point for a mold tool part to support the tamper-indicating anchor piece against inward pressure from the injected molten plastic used to form the container, during the insert-molding operation.)

The annular, ultrasonic energy-directing ridge may extend from the peripheral region of the annular base flange whereby it acts as a mechanical key when the closure assembly is insert molded into the container.

A groove may be provided in the annular base flange adjacent to the annular, ultrasonic energy-directing ridge (to receive molten material displaced during the ultrasonic welding process). Such a groove may also improve the mechanical key between the annular base flange and the injected material of the insert-molded container, when the groove is provided in the peripheral region of the annular base flange.

Two or more of the annular, ultrasonic energy-directing ridges may be provided, spaced from each other transverse to the container opening.

BRIEF DESCRIPTION OF THE DRAWINGS

For the better understanding of the present invention and some of its optional features and further advantages, a description of illustrative embodiments is provided, making reference to the drawings, in which.

DETAILED DESCRIPTION

Figure 1:
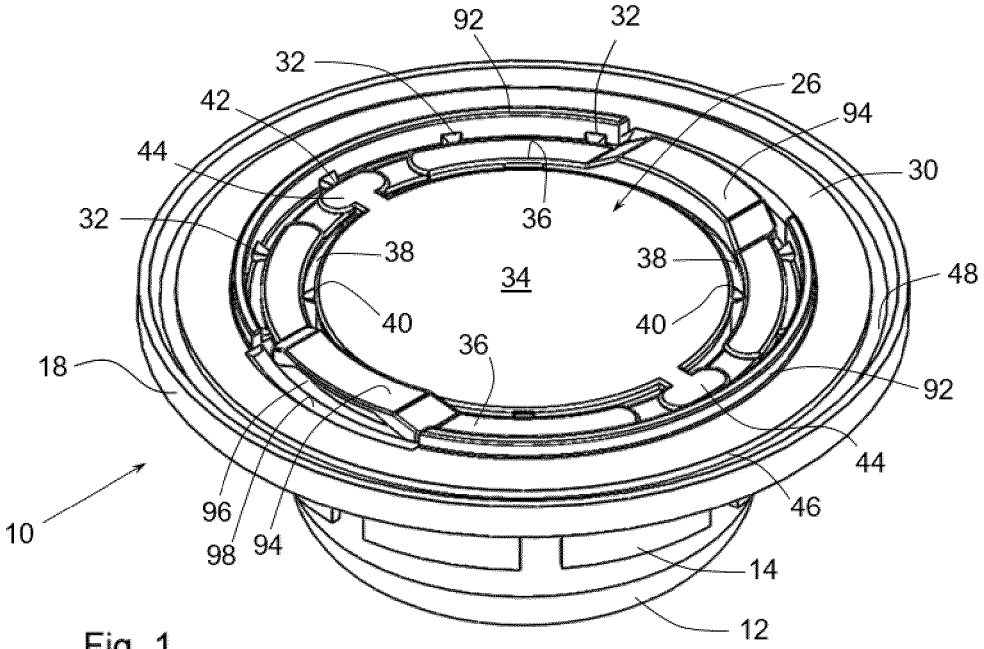
FIG. 1 shows a top perspective view of a closure assembly embodying the invention.

Referring firstly to FIGS. 1-6, a closure assembly 10 embodying the present invention comprises a foldable and extensible neck insert 12 made from a flexible plastics material, such as LDPE. When incorporated in a container and folded as shown, the neck insert 12 is stowed out of the way fully within the interior of the container. When unfolded, the neck insert 12 forms an elongate pouring spout of gently tapered shape, extending from an opening in the container, to allow the container contents to be poured out more easily. A series of petal-like anti-glug baffles 14 are spaced around the periphery of the neck insert 12, and are arranged in known manner so as to deploy and project transversely within the pouring spout, when the neck insert 12 is unfolded and extended.

A through-going passageway 16 leads between an annular base flange 18 of the neck insert 12 and an open end 20 of the neck insert 12. An outer face 17 of a folded frusto-conical portion of the neck insert 12 becomes an inner face defining a continuation of the passageway 16, when the neck insert 12 is extended. Fluid or other flowable material can be dispensed from an opening in a container (not shown in FIGS. 1-6) in and about which opening the base flange 18 is sealingly fixed. The fluid is thus led through the passageway 16 and out through the open end 20 of the neck insert 12. The open end 20 is sealingly closed by a tear-out membrane 22 integrally formed (e.g. molded) with the neck insert 12 and equipped with a pull ring 24.

The open end 20 of the neck insert 12 has an external thread onto which is screwed a closure cap 26 having a side wall 28 with an internal thread to match and mate with the external thread. The closure cap 26 has a tamper-indicating anchor piece 30 attached to it by a frangible connection 32. As shown in the drawings the tamper-indicating anchor piece 30 is a complete circular annulus surrounding the closure cap 26. But this is not essential to the invention, and other forms of anchor piece are possible, such as one or more segments or other-shaped pieces frangibly attached to and extending radially outward from the closure cap 26. The fangible connection 32 shown in the drawings takes the form of a circumferentially distributed series of breakable links; although any other suitable frangible connection may be used, such as a tear strip, a line of perforations, or other line of weakness.

Figure 2:
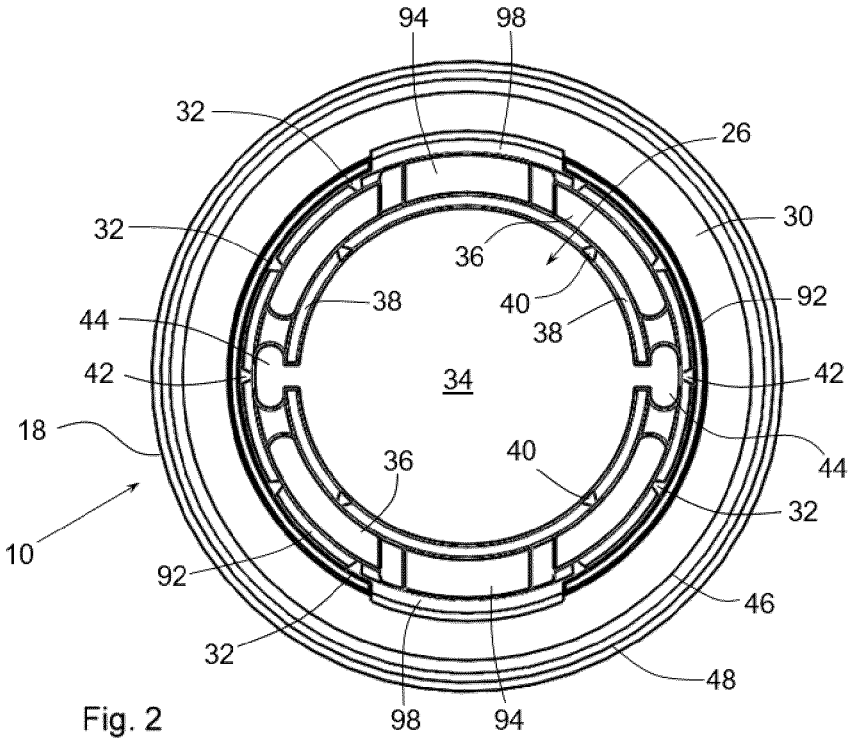
FIG. 2 shows a top plan view of the closure assembly of FIG. 1.
Figure 3:
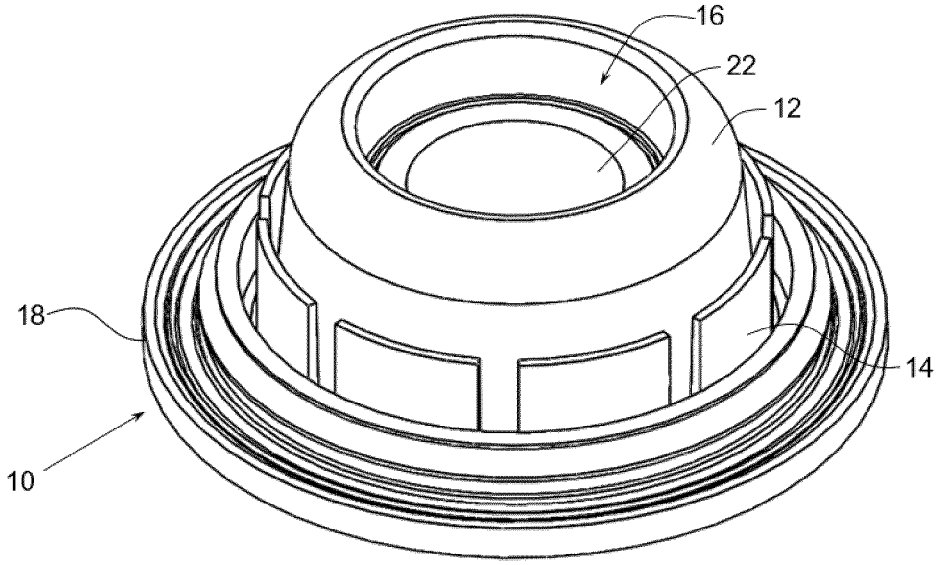
FIG. 3 shows a bottom perspective view of the closure assembly of FIGS. 1 and 2.
Figure 4:
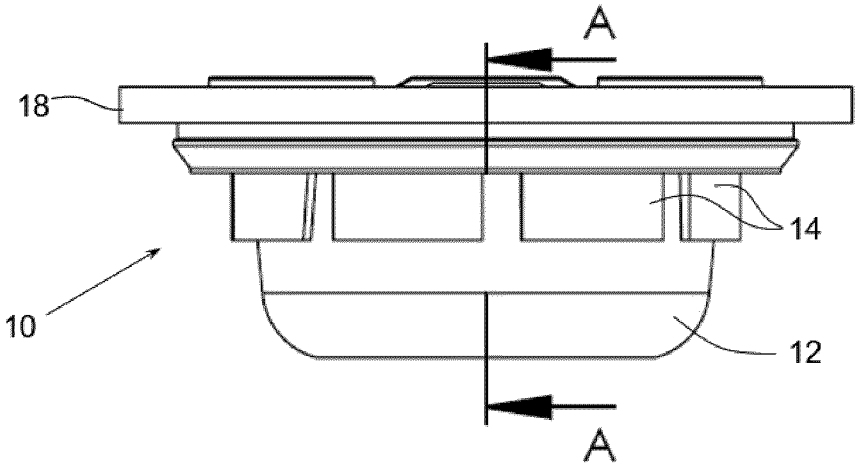
FIG. 4 shows a side view of the closure assembly of FIGS. 1-3.
Figure 5:
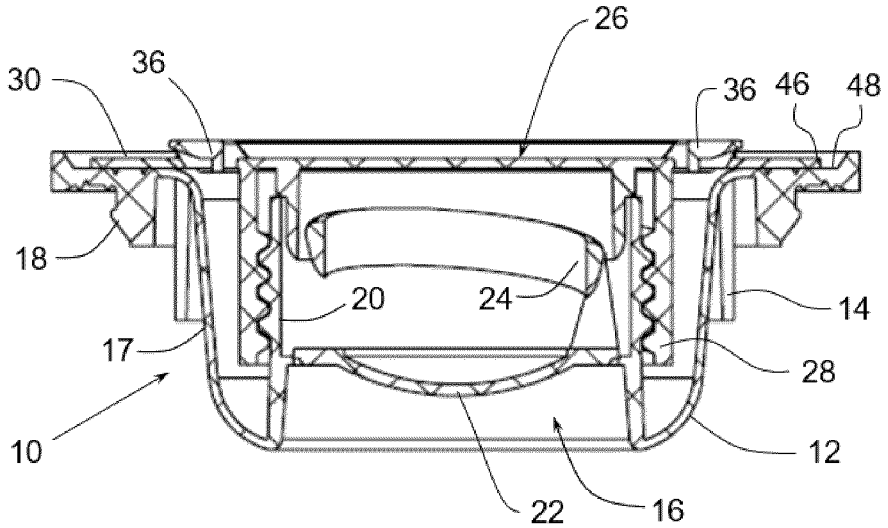
FIG. 5 shows a cross-sectional view taken on line A-A of FIG. 4.

As best shown in FIGS. 1 and 2, the outer rim of the top wall 34 of the closure cap 26 is formed by a pair of bail handles 36. These are delineated from the remainder of the closure cap top wall 34 by a pair of arcuate slots 38. Further breakable links 40 may span the arcuate slots 38. Raising the bail handles 36 by hinging them upwardly breaks the frangible connection 32 and the breakable links 40, to provide further tamper indications in addition to the tear-out membrane 22. Yet further breakable links 42 extend between the anchor piece 30 and attachment ears 44 for the bail handles 36. The attachment ears 44 are substantially rigid with the cap top wall 34 and therefore remain unbroken until the closure cap 26 is pulled upwardly to unfold and extend the neck insert 12.

Each bail handle 36 shown in FIGS. 1 and 2 has a raised center portion 94 defining a finger-accessible recess 96 beneath it, permitting the bail handles to be levered upwards to break the frangible connection 32 and breakable links 40, without the use of tools.

The tamper-indicating anchor piece 30 has a recess 98 adjacent to a center part of each bail handle 36. This improves the mentioned finger access; and provides an optional engagement point for a mold tool part (not shown) to support the tamper-indicating anchor piece 30 against inward pressure from the injected molten plastic that can be used to form the container, during the insert-molding operation.

The closure cap 26 and its bail handles 36, the frangible connection 32, the breakable links 40, 42 and the tamper-indicating anchor piece or pieces 30 may conveniently be formed as a one-piece plastics injection molding; though any other suitable construction can be used. The material of the tamper-indicating anchor piece 30 may be stiffer than the material of the neck insert 12, to provide suitably low distortion during the insert molding or ultrasonic welding operations. When integrally molded with the tamper-indicating anchor piece 30 using the same material, the closure cap 26 will also have good dimensional stability in use. Unlike the neck insert 12, the closure cap 26 is not required to fold and unfold and excessive distortion of the closure cap in use is undesirable. The material of the neck insert 12 when molten should exhibit good wettability with the material of the tamper-indicating anchor piece 30 and/or vice versa, so that they will fuse together by ultrasonic welding, to form a mechanically strong connection. For example when the neck insert 12 is made from LDPE, the tamper-indicating anchor piece 30 may be made from HDPE. Good results are also obtained using materials for the closure cap 26/anchor piece 30 similar to or compatible with the lid material to be applied to the invention, for example HDPE/PP or HDPE/LLDPE mixtures. The annular base flange 18 of the neck insert 12 therefore achieves strong welded connections to both the lid and to the tamper-indicating anchor piece 30 when the closure assembly is secured to the lid by ultrasonic welding rather than by insert-molding.

Referring still mainly to FIGS. 1 and 2, the tamper-indicating anchor piece 30 is shown to comprise a pair of opposed, arcuate ridges 92 protruding from its upper surface. These stiffen the anchor piece 30 and other components of the closure assembly supported thereby (such as the annular base flange 18 of the neck insert 12). The closure assembly is therefore better able to resist distortion when heated and subjected to the pressure of molten plastic during the insert-molding process; as well as resisting distortion during the ultrasonic welding process or processes. Although not shown in FIGS. 12 and 13, to improve such resistance, the protruding ridges 30 may be supported in or against part of the mold tool during the insert molding operation. The ridges 30 also surround, partially house and physically protect the exposed parts 34, 36, 44 of the closure cap and the frangible connections 32, 40, 42 in use in the supply chain or in use by the end customer; while still allowing easy access for removal of the closure cap 34 from the open end 20 of the neck insert 12.

As best shown in FIGS. 5, 6, 9, 12 and 13, the neck insert 12 and the closure cap 26 are configured so that a radially outer edge part 46 of the tamper-indicating anchor piece 30 extends adjacent to (e.g. abuts) a peripheral region 48 of the annular base flange 18. Due to the close proximity of the edge part 46 of the tamper-indicating anchor piece 30 and the peripheral region 48 of the annular base flange 18, the closure assembly can be easily insert-molded into the opening of the container, which may be molded, for example injection molded, around both the peripheral region 48 and the edge part 46, with the closure assembly 10 suitably positioned and held in the mold tool.

Figure 6:
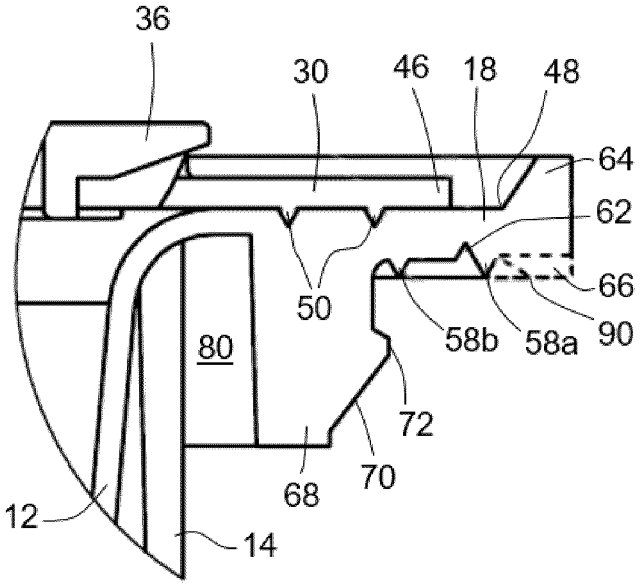
FIG. 6 shows detail A of FIG. 6 drawn to a larger scale.
Figure 9:
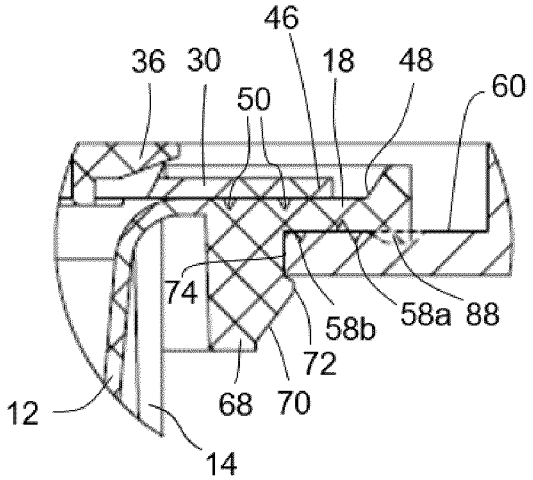
FIG. 9 shows detail B of FIG. 8 drawn to a larger scale.
Figure 10:
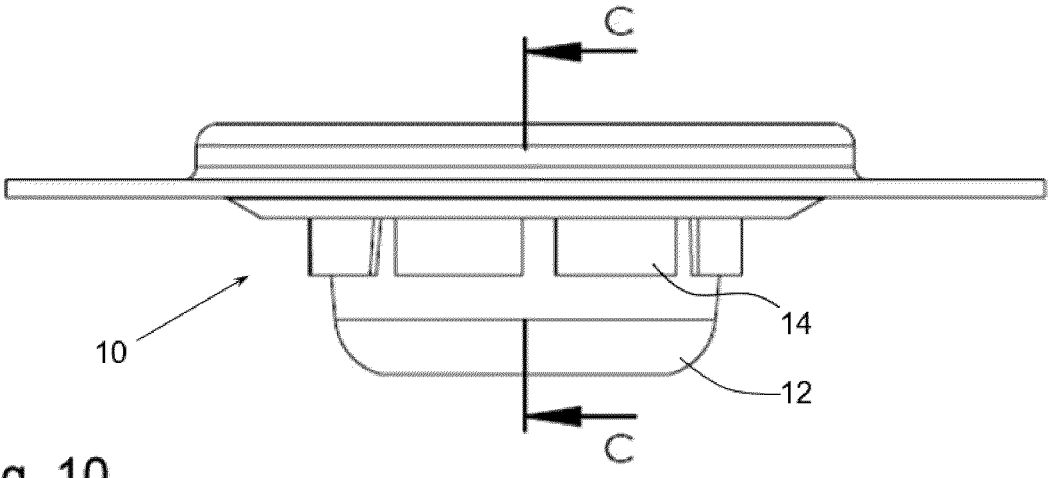
FIG. 10 shows a side view of the closure assembly of FIGS. 1-6 secured across an opening in a container or container component formed by insert molding.
Figure 11:
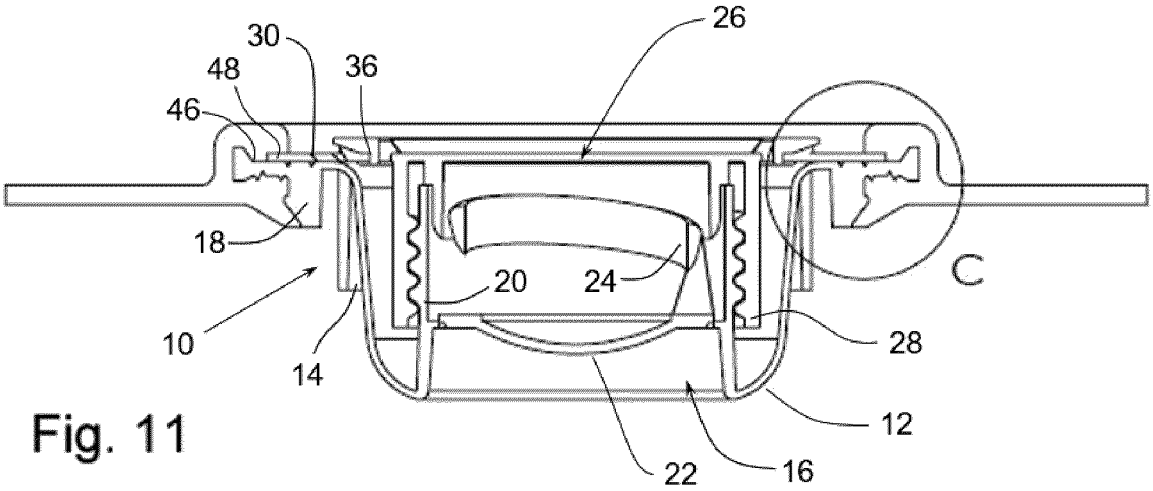
FIG. 11 shows a cross-section taken on line C-C of FIG. 10.
Figure 12:
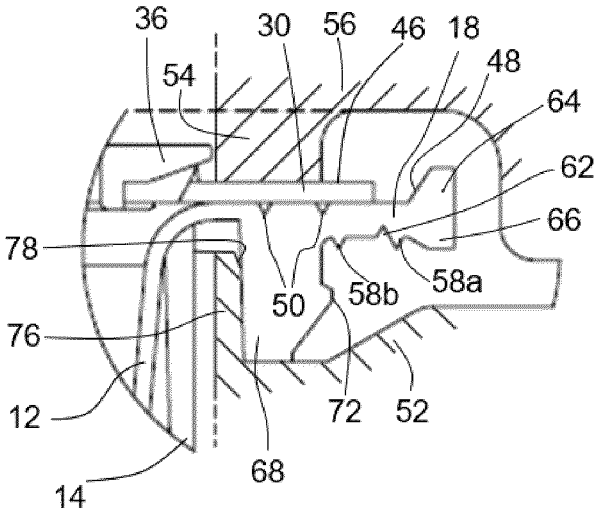
FIG. 12 shows detail C of FIG. 11, drawn to a larger scale.
Figure 13:
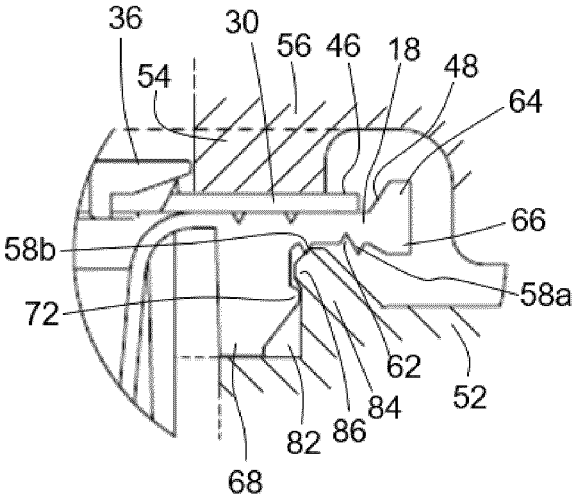
FIG. 13 shows a modification of the closure assembly and mold tools shown in FIG. 12, with alteration of the over injection areas/closure assembly in-mold mounting and retention arrangements.

As best shown in FIGS. 6, 9 and 12, at least one (these Figures show two, for example) ultrasonic energy-directing protrusion 50 spans between adjacent surfaces of the tamper-indicating anchor piece 30 and of the annular base flange 18. FIG. 13 is similar, but for simplicity the ultrasonic energy directing protrusions are unreferenced. These protrusions may be of any suitable shape to concentrate the ultrasonic energy passing between the two components when an ultrasonic welding tool is applied to one or other or both of the tamper-indicating anchor piece 30 and the annular base flange 18. As in the examples illustrated, the protrusions 50 may comprise annular ridges of generally V-shaped profile, extending downwardly from an otherwise generally flat lower surface of the tamper-indicating anchor piece 30, towards an (at least initially) generally flat upper surface of the annular base flange 18. Where a plurality of separate, circumferentially distributed tamper-indicating anchor pieces 30 are used, the protrusions 50 may for example comprise arcuate ridges of generally V-shaped profile. Although not shown in the drawings, before the closure cap 26 reaches a position in which it is fully screwed onto the open end 20 of the neck insert 12, the protrusions 50 may contact the corresponding surface of the annular base flange 18. As screwing on of the closure cap 20 continues towards its final screwed-on position, the foldable part of the neck insert 12 may distort slightly, so that the protrusions 50 continue to space the remainder of the lower surface of the tamper-indicating anchor piece 30 from the upper surface of the annular base flange 18. If the tamper-indicating anchor piece 30 is then welded to the annular base flange 18 prior to delivery of the closure assembly 10 to the container manufacturer or filler, axial pressure from the ultrasonic welding tool will press the tamper-indicating anchor piece 30 against the annular base flange 18. Ultrasonic energy passing through the protrusions 50 causes them to soften and/or melt, and may likewise soften and/or melt neighboring regions of the tamper-indicating anchor piece 30 and of the annular base flange 18. The material of the protrusions 50 and of the tamper-indicating anchor piece 30 therefore fuses with and co-mingles with the material of the annular base flange 18, and the space between these components is reduced or eliminated. FIGS. 6, 9 12 and 13 show the gap completely eliminated, so that facing surfaces of the tamper-indicating anchor piece 30 and of the annular base flange 18 directly abut one another. The annular ridges or other protrusions 50 are diagrammatically shown as remaining distinct, penetrating into the material of the annular base flange 18. However in reality due to fusion and co-mingling of materials, the sharp boundary shown may not exist, but instead there may be a transition in material properties and composition from the material of the tamper-indicating anchor piece 30, across the welded regions, to the material of the annular base flange 18.

On the other hand, when the container closure assembly 10 is delivered to a container manufacturer or a container filler without the tamper-indicating anchor piece 30 being pre-welded to the annular base flange 18 and the closure assembly is then used to form a container by insert-molding, the annular base flange 18 may be supported in a lower mold tool 52 and the tamper-indicating anchor piece 30 pressed against the annular base flange 18 by a clamping ridge 54 of an upper mold tool 56, as shown in FIGS. 12 and 13. The clamping ridge 54 drives the protrusions 50 into the softer material of the annular base flange 18, reducing or eliminating any gap between the annular base flange 18 and the tamper-indicating anchor piece 30 into which the injected molten plastics material used to form the container might otherwise intrude. The protrusions 50 also form a barrier or seal which resists such intrusion, particularly if they extend across the entire width of the tamper-indicating anchor piece 30 exposed to the injected plastic flow. The interface between the tamper-indicating anchor piece 30 and the annular base flange 18 is further protected against the pressure of the injected molten plastic by a blocker ridge 64 upstanding from the upper side of the annular base flange 18. The blocker ridge is overmolded by the material of the container and therefore also improves the mechanical key between the closure assembly and the insert-molded container.

Rather than extending downward from the tamper-indicating anchor piece 30, at least one, and optionally all, of the ultrasonic energy-directing protrusions 50 may extend upwardly from a co-operating upper face of the annular base flange 18.

Figure 8:
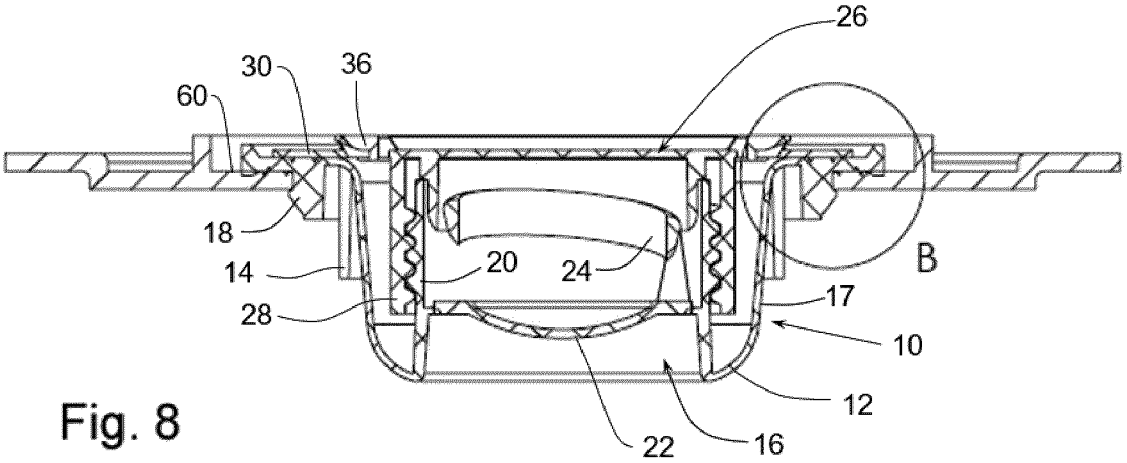
FIG. 8 shows a cross-section taken on line B-B of FIG. 7.

Outboard of the through-going passageway 16 (including its part bounded by the wall 17 when the foldable frusto-conical section of the insert 12 is extended), at least one annular, ultrasonic energy-directing ridge extends from a lower surface of the annular base flange 18. Two such ridges 58*a* and 58*b* are shown by of illustrative example in FIGS. 6, 9 12 and 13. Using such ridges, the annular base flange is securable by ultrasonic welding to an outer wall surface 60 of the container surrounding the dispensing opening of the container, as best seen in FIGS. 8 and 9. During such welding, these ridges and possibly also adjacent material of the annular base flange 18, will fuse and intermingle with adjacent material of the container wall, whereby the ridges 58*a* and 58*b* may no longer remain as sharp boundaries within and between the annular base flange 18 and the adjacent part of the container wall. There is instead a transition from the material of the annular base flange 18, through the welded regions and into the material of the container wall: similar to the structure described above in relation to the protrusions 50. Again similarly to the illustration of the protrusions 50 in FIGS. 6, 9 and 12, for simplicity the ridges 58*a* and 58*b* are shown diagrammatically in FIG. 9 as remaining distinct, penetrating into the material of the container wall.

Figure 7:
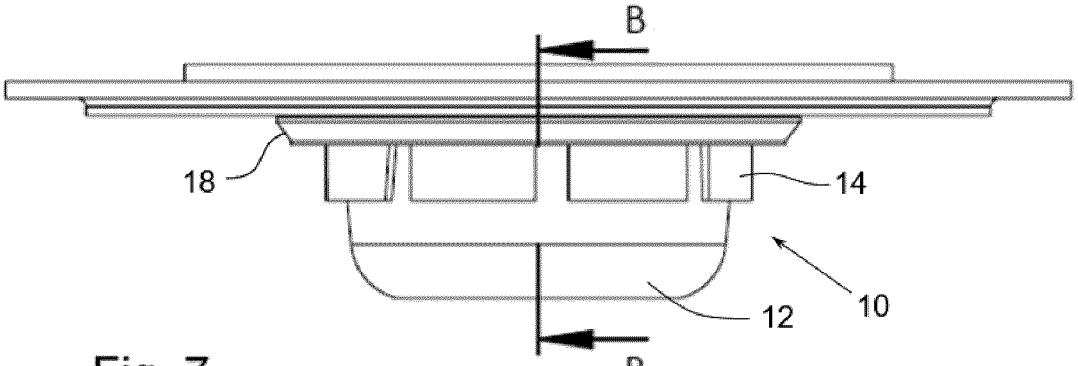
FIG. 7 shows a side view of the closure assembly of FIGS. 1-6 secured across an opening in a container or container component by ultrasonic welding.

Referring back to FIG. 6, the annular base flange 18 is provided with a depending collar 68. When the closure assembly 10 is to be ultrasonically welded to a pre-formed plastics container, the depending collar 68 is first snap-fitted into the container opening, as shown in FIGS. 7-9. A lead-in chamfer 70 guides a bead 72 on the external circumferential surface of the collar 68 through the bore 74 of the container opening, under compression. Once through the bore 74, the bead 72 is no longer under compression, and snaps outwardly beneath the lower surface of the container wall. The upper surface 60 of the container wall is thereby held in firm engagement with the annular ridges 58*a*, 58*b*, in the correct position ready for the ultrasonic welding operation. The diameter of the collar 68 may be sized to be an interference fit in the bore 74 of the container opening, so that the collar remains resiliently loaded against the bore to provide a mechanical fluid seal, in addition to the fluid seal provided either by (i) ultrasonic welding of the annular ridges 58*a*, 58*b* to the container wall in a position around the container opening, or by (ii) insert molding, whereby the plastics material used to form the container is overmolded around the peripheral region 48 of the annular base flange 18. This material may also be used to secure the anchor piece 30 to the annular base flange as well as or instead of ultrasonic welding, as described above.

The depending collar 68 or similar mechanical interengagement means may also facilitate placement and retention of the closure assembly in the correct position within a mold tool, ready for closure of the mold and formation of the container about the closure assembly by insert molding. FIG. 12 shows that the mold tool 52 may comprise an upstanding annular wall 76 whose upper, outer edge is provided with a lead-in chamfer 78. The wall 76 is received in an annular space 80 (see FIG. 6) defined between the inside of the depending collar 68 and the baffles 14. FIG. 12 also shows that the depending collar 68 with its bead 72 (or similar mechanical interengagement means) may be used to provide an additional mechanical key when the closure assembly is fixed and sealed to the container by insert-molding. The injected molten plastic flows up against the outer circumference of the depending collar 68 and embeds the bead 72.

FIG. 13 shows a modification of the lower mold tool 52, in which the upstanding annular wall 76 of FIG. 12 is omitted. Instead, the depending collar 68 is received in an annular pocket 82 formed in the mold tool 52. The pocket 82 has an upstanding rim 84, provided with a radially inwardly directed retaining lip 86. The bead 72 snaps beneath the retaining lip 86, via the lead-in chamfer 70 (FIG. 6) and a corresponding chamfer on the rim 84, above the retaining lip 86. The closure assembly 10 is thereby firmly held in the correct position in the mold tool 52, ready for closure of the mold and insert-molding of the container. The ridge 58*b* is compressed against the upper edge of the rim 84 or its chamfer and helps to seal the mold against escape of injected molten plastic. The rim 84 thus reduces the width of the annular overmolded region beneath the outer edge of the annular base flange 18. As also shown, the clamping ridge 54 of the upper mold tool 56 may be slightly widened in comparison to that of FIG. 12, so that the width of the annular overmolded region above the outer edge of the annular base flange 18 is correspondingly reduced. When the injected plastic has cooled and solidified, the molded container thus formed can be ejected from the mold tools 52, 56 by the usual ejector pins (not shown); at the same time disengaging the bead 72 of the incorporated closure assembly 10 from beneath the retaining lip 86.

Placement of the closure assembly either in/over the opening of a pre-formed container, or in the mold tool 52 ready to form the container by insert-molding, may be manual or automatic, e.g. by a pick-and-place robot or the like.

As best seen in FIG. 6, a groove 62 is provided in the annular base flange 18 adjacent to the annular, ultrasonic energy-directing ridge 58*a*. The groove 62 receives molten material displaced during the ultrasonic welding process. Where an ultrasonic energy-directing ridge (such as ridge 58*b*) lies sufficiently close to the edge of the opening in the container, the molten material may penetrate the interface between the depending collar 68 and the bore 74 of the pre-formed container opening (FIG. 9) which further improves the fluid seal and mechanical fixation between the closure assembly 10 and the container. Hence in that case, a corresponding grove similar to 62 to receive the molten material may not be necessary. As the groove 62 lies in the peripheral region of the annular base flange 18 which is overmolded with the material of the container when the closure assembly is used in insert-molding, such a groove also improves the mechanical key between the annular base flange 18 and the injected material of the insert-molded container. The annular base flange 18 may be stiffened by an outer peripheral downward rim extension 66, which also similarly improves the mechanical key between the annular base flange and the injected material. In that case, the upper surface 60 of the pre-molded container adjacent to the bore 74 is provided with an annular depression 88 to accommodate the downward rim extension 66 (see FIGS. 6 and 9). Alternatively, apart from the ridges 58*a*, 58*b* and the groove 62, the lower surface 90 of the annular base flange 18 outboard of the downwardly extending collar 68 may be substantially flat, in which case the depression 88 is unnecessary.

The invention claimed is:

1. A closure assembly for a container, the closure assembly comprising:

a neck insert formed from a plastics material and comprising (a) a through-going passageway, (b) an annular base flange sealingly securable about an opening in the container so as to provide sealed fluid communication between the passageway and the opening in the container, and (c) an open end through which fluid can be dispensed from the container;

and a closure plug or cap removably securable to the neck insert so as to provide an openable fluid-tight seal across the open end;

the closure cap or plug having a tamper-indicating anchor piece formed from a plastics material and attached to the closure cap or plug by a frangible connection, an edge part of the tamper-indicating anchor piece extending adjacent to a peripheral region of the annular base flange, for insert molding into the opening of the container, with material of the container sealingly molded around the peripheral region of the annular base flange and around the edge part of the tamper-indicating anchor piece;

characterized in that an ultrasonic energy-directing protrusion spans between adjacent surfaces of the tamper-indicating anchor piece and of the annular base flange, and an annular, ultrasonic energy-directing ridge extends from a lower surface of the annular base flange, outboard of the through-going passageway, whereby the tamper-indicating anchor piece is securable by ultrasonic welding to the annular base flange and the annular base flange is securable by ultrasonic welding to an outer wall surface of the container surrounding the opening in the container, so as to provide the sealed fluid communication between the passageway and the opening in the container.

2. The closure assembly of claim 1, further comprising means to provide mechanical interengagement or resilient sealing between the annular base flange and the container opening.

3. The closure assembly of claim 2, in which the mechanical interengagement comprises a snap-in collar.

4. The closure assembly of claim 2, in which the mechanical interengagement or resilient sealing means facilitate placement and retention of the closure assembly within the opening of a pre-molded container, or placement and retention of the closure assembly in a predetermined position within a mold tool for formation of the container about the closure assembly by insert molding.

5. The closure assembly of claim 1, in which the tamper-indicating anchor piece comprises a ridge protruding from its upper surface.

6. The closure assembly of claim 1, in which the tamper-indicating anchor piece is annular.

7. The closure assembly of claim 1, comprising a plurality of tamper-indicating anchor pieces.

8. The closure assembly of claim 7, in which the tamper-indicating anchor pieces are spaced about the periphery of the closure assembly.

9. The closure assembly of claim 7, in which the tamper-indicating anchor pieces are shaped as arcuate segments.

10. The closure assembly of claim 1, comprising two or more of the energy-directing protrusions spaced from each other in a direction radially of the container opening.

11. The closure assembly of claim 1, in which, when the closure assembly is fixed in the container opening by insert-molding, the energy-directing protrusion(s) are arranged to be compressed by co-operating parts of the mold tool so as to bite into and/or deform against the annular base flange.

12. The closure assembly of claim 1, in which the energy-directing protrusions are used to pre-weld the tamper-indicating anchor piece to the annular base flange prior to installation of the closure assembly in or over the container opening.

13. The closure assembly of claim 1, in which the closure cap or plug comprises a bail handle.

14. The closure assembly of claim 13, in which the frangible connection is attached to the bail handle so as to be at least partially broken when the bail handle is hinged upwardly.

15. The closure assembly of claim 14, in which a further frangible connection is provided between the bail handle and the remainder of the closure cap or plug and which is arranged to be broken when the bail handle is hinged upwardly.

16. The closure assembly of claim 13, in which the bail handle has a raised center portion defining a recess beneath it.

17. The closure assembly of claim 13, in which the tamper-indicating anchor piece has a recess adjacent to a center part of the bail handle.

18. The closure assembly of claim 1, in which the annular, ultrasonic energy-directing ridge extends from the peripheral region of the annular base flange whereby it acts as a mechanical key when the closure assembly is insert molded into the container.

19. The closure assembly of claim 1, in which a groove is provided in the annular base flange adjacent to the annular, ultrasonic energy-directing ridge.

20. The closure assembly of claim 1, in which two or more of the annular, ultrasonic energy-directing ridges are provided, spaced from each other transverse to the container opening.

21. The closure assembly of claim 2, in which the resilient sealing means comprises a snap-in collar.

* * * * *